US009792740B2

(12) United States Patent
Lambert et al.

(10) Patent No.: US 9,792,740 B2
(45) Date of Patent: Oct. 17, 2017

(54) TRIGGERING A SPECIALIZED DATA COLLECTION MODE

(71) Applicant: Lytx, Inc., San Diego, CA (US)

(72) Inventors: Daniel Lambert, Carlsbad, CA (US); Larry Richardson, San Diego, CA (US)

(73) Assignee: Lytx, Inc., San Diego, CA (US)

( * ) Notice: Subject to any disclaimer, the term of this patent is extended or adjusted under 35 U.S.C. 154(b) by 0 days.

(21) Appl. No.: 14/965,035

(22) Filed: Dec. 10, 2015

(65) Prior Publication Data

US 2016/0098868 A1 Apr. 7, 2016

Related U.S. Application Data

(63) Continuation of application No. 14/034,296, filed on Sep. 23, 2013, now Pat. No. 9,240,079, which is a continuation-in-part of application No. 13/448,725, filed on Apr. 17, 2012, now Pat. No. 8,676,428.

(51) Int. Cl.
*G07C 5/08* (2006.01)
*G07C 5/00* (2006.01)

(52) U.S. Cl.
CPC ..... *G07C 5/08* (2013.01); *G07C 5/008* (2013.01); *G07C 5/0866* (2013.01)

(58) Field of Classification Search
CPC ..... G07C 5/008; G07C 5/08; G07C 5/0866
USPC ..... 701/29.1
See application file for complete search history.

(56) References Cited

U.S. PATENT DOCUMENTS 5,862,500 A * 1/1999 Goodwin ..... G07C 5/085 340/438
7,130,812 B1 * 10/2006 Iyer ..... G06F 17/3051 705/28
7,853,376 B2 12/2010 Peng
8,400,296 B2 * 3/2013 Brinton ..... G07C 5/008 340/539.11
2005/0088291 A1 * 4/2005 Blanco ..... G07C 5/0891 340/441
2006/0276942 A1 * 12/2006 Anderson ..... G07C 5/0858 701/33.4

(Continued)

FOREIGN PATENT DOCUMENTS

CN 101178836 5/2008
CN 101625772 1/2010
CN 202026426 11/2011

*Primary Examiner* — Atul Trivedi
(74) *Attorney, Agent, or Firm* — Van Pelt, Yi & James LLP

(57) ABSTRACT

A system for triggering a specialized data collection mode of a vehicle event recorder comprises an input interface, a processor, and an output interface. The input interface is configured to receive a trigger indication from an external trigger source. The processor is configured to determine whether the trigger indication comprises an indication to enter into a specialized data collection mode and, in the event that the trigger indication comprises the indication to enter into the specialized data collection mode, to determine a vehicle event recorder associated with the trigger indication. The output interface is configured to provide a specialized data collection mode indication to enter the specialized data collection mode to the vehicle event recorder in the event that the trigger indication comprises the indication to enter into the specialized data collection mode.

21 Claims, 5 Drawing Sheets

(56) References Cited

U.S. PATENT DOCUMENTS

| | | | | |
|---|---|---|---|---|
| 2007/0005202 | A1* | 1/2007 | Breed | B60W 50/0205 701/29.1 |
| 2008/0174423 | A1* | 7/2008 | Breed | B60N 2/002 340/539.22 |
| 2011/0060496 | A1* | 3/2011 | Nielsen | G06Q 10/0631 701/31.4 |
| 2011/0095940 | A1* | 4/2011 | Breed | G01F 23/20 342/146 |
| 2012/0004805 | A1* | 1/2012 | Gray | B60T 8/1708 701/33.4 |
| 2015/0126212 | A1* | 5/2015 | Karabinis | G01D 21/00 455/454 |
| 2015/0203125 | A1* | 7/2015 | Penilla | G06F 21/445 701/1 |
| 2015/0210287 | A1* | 7/2015 | Penilla | B60W 40/08 701/49 |

* cited by examiner

TRIGGERING A SPECIALIZED DATA COLLECTION MODE

CROSS REFERENCE TO OTHER APPLICATIONS

This application is a continuation of U.S. patent application Ser. No. 14/034,296, now U.S. Pat. No. 9,240,079, entitled TRIGGERING A SPECIALIZED DATA COLLECTION MODE filed Sep. 23, 2013, which is incorporated herein by reference for all purposes, which is a continuation in part of U.S. patent application Ser. No. 13/448,725, now U.S. Pat. No. 8,676,428, entitled SERVER REQUEST FOR DOWNLOADED INFORMATION FROM A VEHICLE-BASED MONITOR filed Apr. 17, 2012, which is incorporated herein by reference for all purposes.

BACKGROUND OF THE INVENTION

Modern vehicles (e.g., airplanes, boats, trains, cars, trucks, etc.) can include a vehicle event recorder in order to better understand the timeline of an anomalous event (e.g., an accident). A vehicle event recorder typically includes a set of sensors, e.g., video recorders, audio recorders, accelerometers, gyroscopes, vehicle state sensors, GPS (global positioning system), etc., that report data, which is used to determine the occurrence of an anomalous event. If an anomalous event is detected, then sensor data related to the event is recorded and transmitted to a vehicle data server for later review. In some embodiments, the vehicle data server determines that sensor data should be recorded by the vehicle event recorder and transmitted for review even though an anomalous event has not been detected by the event recorder.

BRIEF DESCRIPTION OF THE DRAWINGS

Various embodiments of the invention are disclosed in the following detailed description and the accompanying drawings.

DETAILED DESCRIPTION

Figure 1:
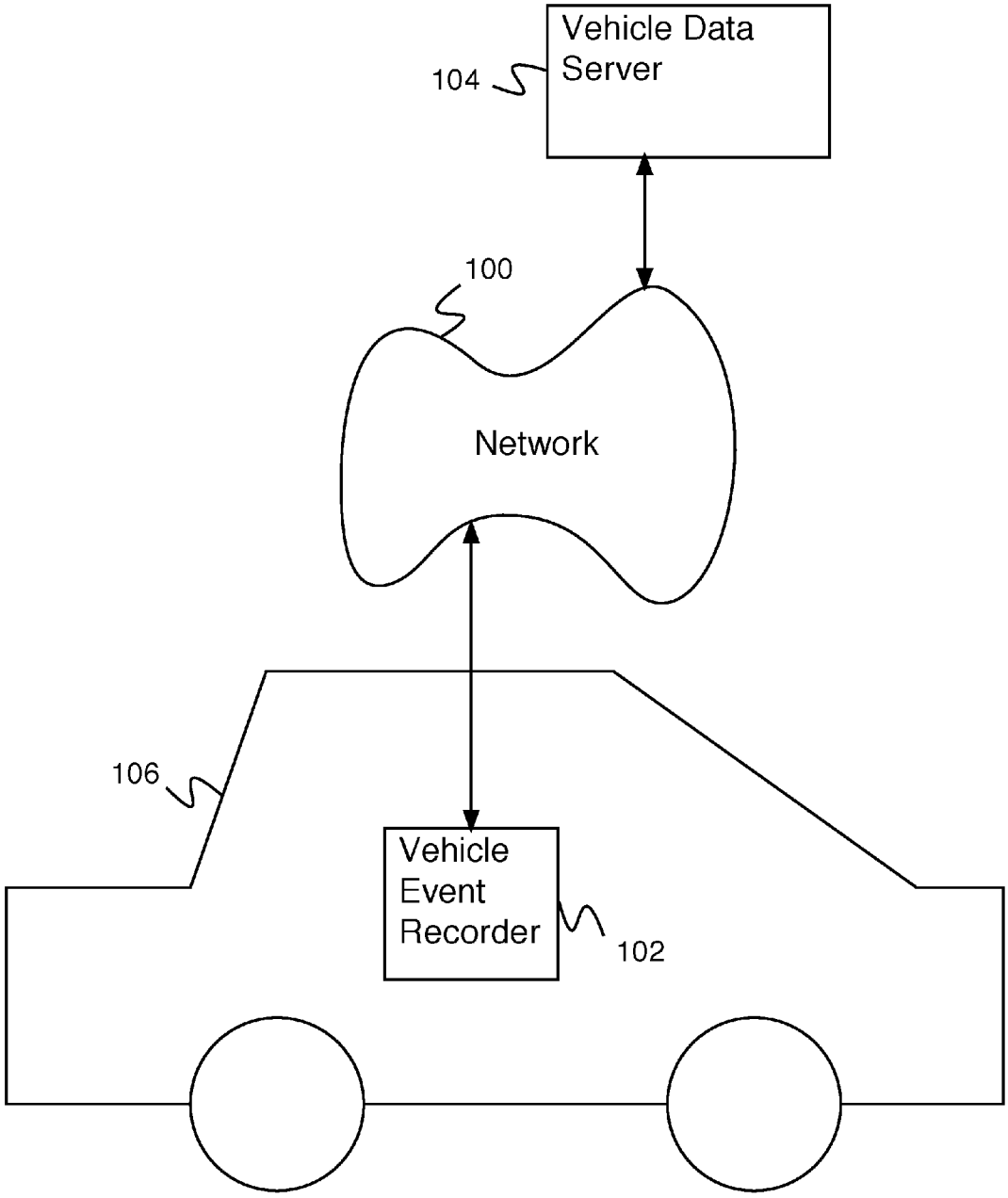
FIG. 1 is a block diagram illustrating an embodiment of a system including a vehicle event recorder.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A system for triggering a specialized data collection mode is disclosed. A system for triggering a specialized data collection mode comprises an input interface configured to receive an indication from an external trigger source; a processor configured to determine whether the trigger indication comprises an indication to enter into a specialized data collection mode; in the event that the trigger indication comprises the indication to enter into the specialized data collection mode, determine a vehicle event recorder associated with the trigger indication; and an output interface configured to provide a specialized data collection mode indication to enter the specialized data collection mode to the vehicle event recorder in the event that the trigger indication comprises the indication to enter into the specialized data collection mode. The system for triggering a specialized data collection mode additionally comprises a memory coupled to the processor and configured to provide the processor with instructions.

A vehicle event recorder mounted on a vehicle records vehicle data and anomalous vehicle events. Anomalous vehicle event types include accidents, speed limit violations, rough road events, hard maneuvering events (e.g., hard cornering, hard braking), dangerous driving events (e.g., cell phone usage, eating while driving, working too long of a shift, sleepy driving, etc.), and any other appropriate kind of anomalous vehicle events. The vehicle event recorder analyzes data from sensors (e.g., video recorders, audio recorders, accelerometers, gyroscopes, vehicle state sensors, GPS, etc.) to determine when an anomalous event has occurred. The vehicle event recorder transmits event data, including sensor data, to a vehicle data server, where the data is stored and analyzed. The vehicle event recorder can enter a specialized data collection mode, where the vehicle event recorder collects data describing the vehicle state (e.g., internal video data, sensor data, etc.). In some embodiments, when the vehicle event recorder enters the specialized data collection mode, the data describing the vehicle state is immediately transmitted to the vehicle data server. In some embodiments, when the vehicle event recorder enters the specialized data collection mode, a single data collection is performed (e.g., a predetermined duration—for example, 5 seconds—of video or sensor data is captured, a still image is captured, etc.). In some embodiments, when the vehicle event recorder enters the specialized data collection mode, multiple data collections are performed (e.g., data is collected repeatedly). The vehicle event recorder specialized data collection mode comprises a mode for quickly conveying information about what is going on in the vehicle to the vehicle data server.

In some embodiments, the vehicle data server initiates the specialized data collection mode by transmitting an indication to enter the specialized data collection mode to the event recorder (e.g., the vehicle data server has determined that it needs information about what is going on in the vehicle to the vehicle data server and so triggers the specialized data collection mode to get that data). The vehicle data server transmits the indication to enter the specialized data collection mode to the event recorder in response to receiving an indication from an external trigger source. When the vehicle data server receives the indication from the external trigger source, it determines that the indication comprises an indication to enter into the specialized data collection mode, and transmits the indication to the vehicle event recorder. The external trigger source comprises an external indication that there is something out of the ordinary going on in the vehicle, and that the vehicle data server should immediately investigate. In various embodiments, the external trigger source comprises an indication of an incorrect driver ID, an indication of a dangerous driver behavior, an indication of a route deviation, an indication of an incorrect geozone, a manual indication (e.g., a manager at the vehicle data server triggers the indication), a stolen vehicle recovery system indication, a call-in driver alert system indication, an electronic on-board recorder (e.g., EOBR) system indication, or any other appropriate external trigger source.

In some embodiments, the processor of the vehicle event recorder is configured to connect to a vehicle communication bus. The vehicle data server provides instruction to the vehicle event recorder to collect and transmit data collected via the vehicle communication bus. The server is configured to receive data from the vehicle communication bus.

FIG. 1 is a block diagram illustrating an embodiment of a system including a vehicle event recorder. Vehicle event recorder 102 comprises a vehicle event recorder mounted in a vehicle (e.g., a car or truck). In some embodiments, vehicle event recorder 102 includes or is in communication with a set of sensors—for example, video recorders, audio recorders, accelerometers, gyroscopes, vehicle state sensors, GPS, outdoor temperature sensors, moisture sensors, laser line tracker sensors, or any other appropriate sensors. In various embodiments, vehicle state sensors comprise a speedometer, an accelerator pedal sensor, a brake pedal sensor, an engine revolutions per minute (e.g., RPM) sensor, an engine temperature sensor, a headlight sensor, an airbag deployment sensor, driver and passenger seat weight sensors, an anti-locking brake sensor, an engine exhaust sensor, a gear position sensor, a cabin equipment operation sensor, or any other appropriate vehicle state sensors. In some embodiments, vehicle event recorder 102 comprises a system for processing sensor data and detecting events. In some embodiments, vehicle event recorder 102 comprises a system for detecting risky behavior. In various embodiments, vehicle event recorder 102 is mounted to vehicle 106 in one of the following locations: the chassis, the front grill, the dashboard, the rear-view mirror, or any other appropriate location. In some embodiments, vehicle event recorder 102 comprises multiple units mounted in different locations in vehicle 106. In some embodiments, vehicle event recorder 102 comprises a communications system for communicating with network 100. In various embodiments, network 100 comprises a wireless network, a wired network, a cellular network, a Code Division Multiple Accessing (CDMA) network, a Global System For Mobile (GSM) communications network, a local area network, a wide area network, the Internet, or any other appropriate network. In some embodiments, network 100 comprises multiple networks, changing over time and location. In some embodiments, different networks comprising network 100 comprise different bandwidth cost (e.g., a wired network has a very low cost, a wireless Ethernet connection has a moderate cost, a cellular data network has a high cost). In some embodiments, network 100 has a different cost at different times (e.g., a higher cost during the day and a lower cost at night). Vehicle event recorder 102 communicates with vehicle data server 104 via network 100. Vehicle event recorder 102 is mounted on vehicle 106. In various embodiments, vehicle 106 comprises a car, a truck, a commercial vehicle, or any other appropriate vehicle. Vehicle data server 104 comprises a vehicle data server for collecting events and risky behavior detected by vehicle event recorder 102. In some embodiments, vehicle data server 104 comprises a system for collecting data from multiple vehicle event recorders. In some embodiments, vehicle data server 104 comprises a system for analyzing vehicle event recorder data. In some embodiments, vehicle data server 104 comprises a system for displaying vehicle event recorder data. In some embodiments, vehicle data server 104 is located at a home station (e.g., a shipping company office, a taxi dispatcher, a truck depot, etc.). In some embodiments, events recorded by vehicle event recorder 102 are downloaded to vehicle data server 104 when vehicle 106 arrives at the home station. In some embodiments, vehicle data server 104 is located at a remote location. In some embodiments, events recorded by vehicle event recorder 102 are downloaded to vehicle data server 104 wirelessly. In some embodiments, a subset of events recorded by vehicle event recorder 102 is downloaded to vehicle data server 104 wirelessly.

Figure 2:
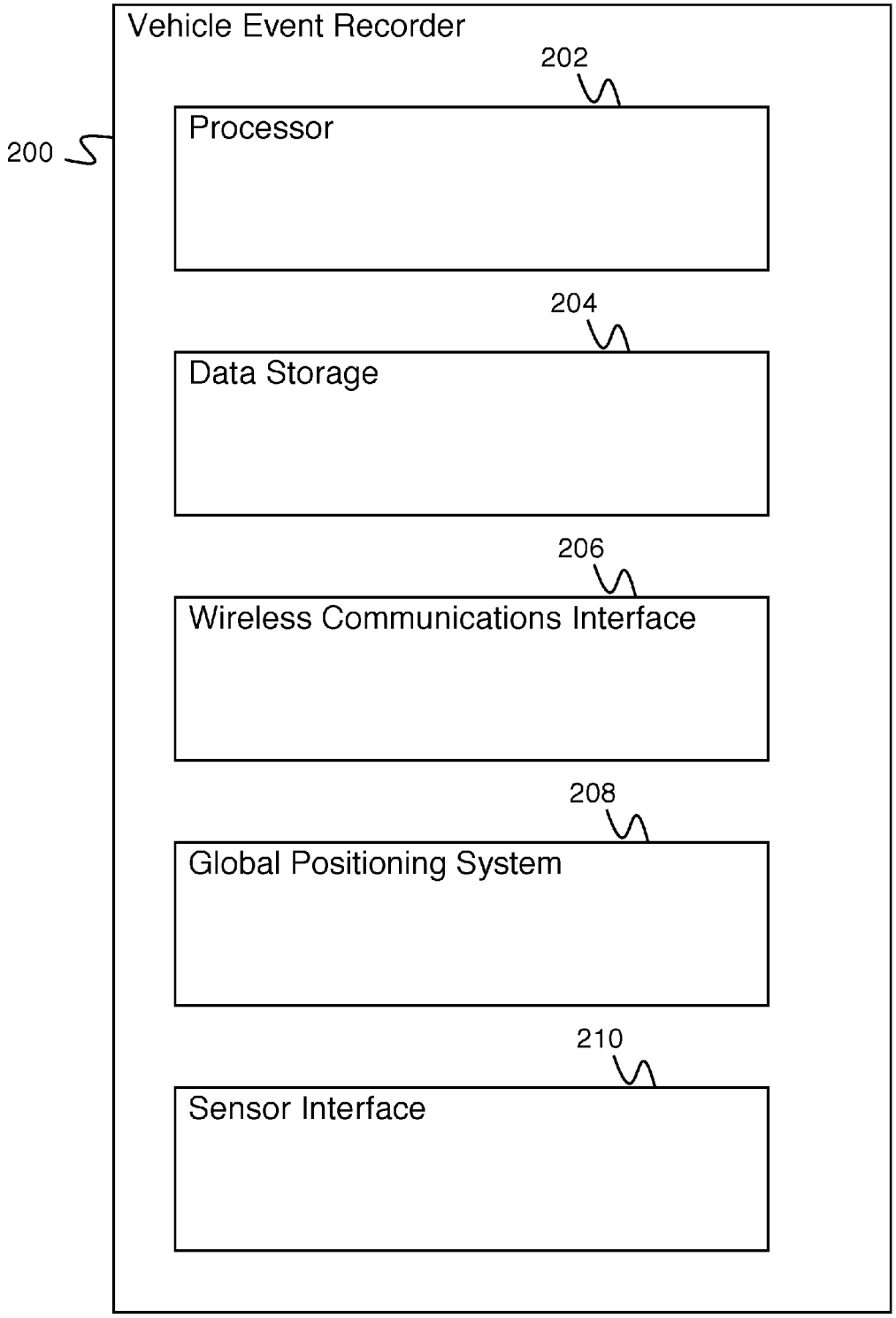
FIG. 2 is a block diagram illustrating an embodiment of a vehicle event recorder.

FIG. 2 is a block diagram illustrating an embodiment of a vehicle event recorder. In some embodiments, vehicle event recorder 200 of FIG. 2 comprises vehicle event recorder 102 of FIG. 1. In the example shown, vehicle event recorder 200 comprises processor 202. Processor 202 comprises a processor for controlling the operations of vehicle event recorder 200, for reading and writing information on data storage 204, for communicating via wireless communications interface 206, for determining a position using global positioning system 208, and for reading data via sensor interface 210. Data storage 204 comprises a data storage (e.g., a random access memory (RAM), a read only memory (ROM), a nonvolatile memory, a flash memory, a hard disk, or any other appropriate data storage). In various embodiments, data storage 204 comprises a data storage for storing instructions for processor 202, vehicle event recorder data, vehicle event data, sensor data, video data, map data, or any other appropriate data. In various embodiments, wireless communications interface 206 comprises one or more of a GSM interface, a CDMA interface, a WiFi interface, or any other appropriate interface. Global positioning system 208 comprises a global positioning system (e.g., GPS) for determining a system location. Sensor interface 210 comprises an interface to one or more vehicle event recorder sensors. In various embodiments, vehicle event recorder sensors comprise an external video camera, an internal video camera, a microphone, an accelerometer, a gyroscope, an outdoor temperature sensor, a moisture sensor, a laser line tracker sensor, vehicle state sensors, or any other appropriate sensors. In various embodiments, vehicle state sensors comprise a speedometer, an accelerator pedal sensor, a brake pedal sensor, an engine revolution per minute sensor, an engine temperature sensor, a headlight sensor, an airbag deployment sensor, driver and passenger seat weight sensors, an anti-locking brake sensor, an engine exhaust sensor, a gear position sensor, a cabin equipment operation sensor, or any other appropriate vehicle state sensors. In some embodiments, sensor interface 210 comprises an on-board diagnostics (OBD) bus. In some embodiments, vehicle event recorder 200 communicates with vehicle state sensors via OBD bus.

Figure 3:
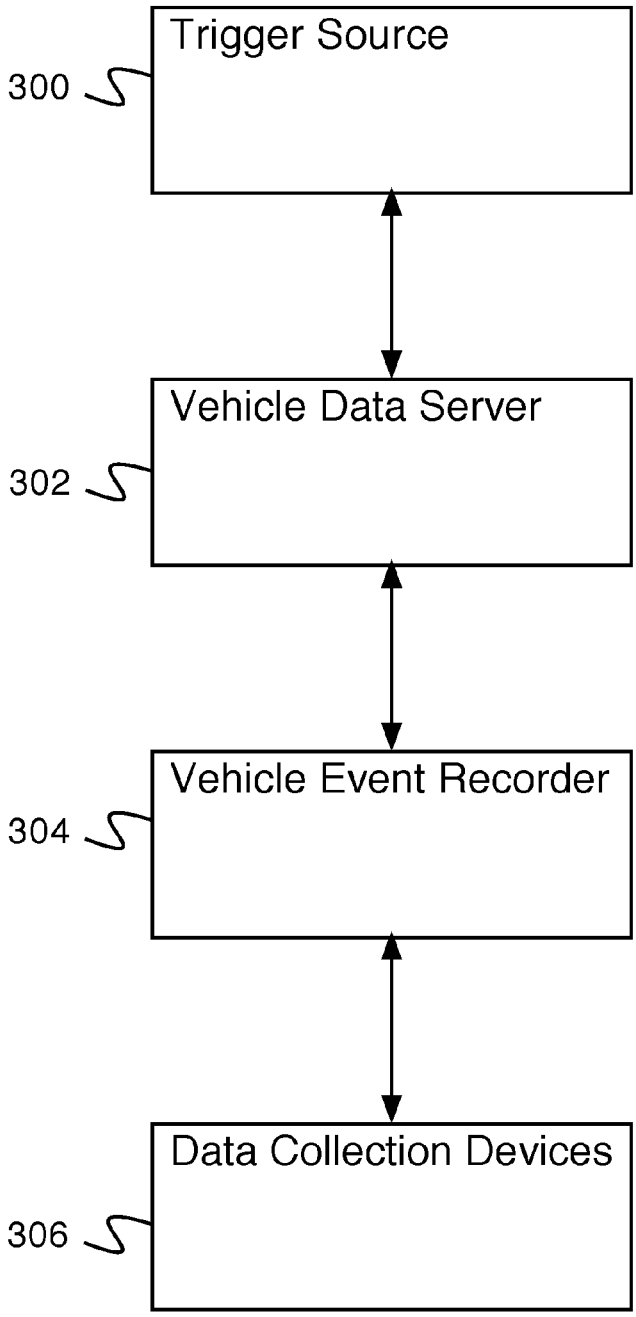
FIG. 3 is a block diagram illustrating an embodiment of a system for triggering a specialized data collection mode.

FIG. 3 is a block diagram illustrating an embodiment of a system for triggering a specialized data collection mode. In the example shown, trigger source 300 comprises a trigger source for sending an indication. In some embodiments, the indication comprises an indication that vehicle data should be captured. In various embodiments, trigger source 300 comprises an indication of an incorrect driver ID, an indication of a dangerous driver behavior, an indication of a route deviation, an indication of an incorrect geozone, a manual indication (e.g., a manager at the vehicle data server triggers the indication), a stolen vehicle recovery system indication, a call-in driver alert system indication, an electronic on-board recorder (e.g., EOBR) system indication, or any other appropriate external trigger source. In some embodiments, trigger source 300 comprises part of vehicle event recorder 304 (e.g., vehicle event recorder 304 is a source of trigger information that a vehicle data server uses to determine whether vehicle event recorder 304 should enter a specialized collection mode). Trigger source 300 sends an indication to vehicle data server 302. Vehicle data server 302 receives the indication and determines whether the indication comprises an indication to enter into a specialized data collection mode. In various embodiments, determining whether the indication comprises an indication to enter into a specialized data collection mode comprises determining the trigger source (e.g., who sent the indication), determining the indication type, determining the indication contents, determining the indication severity, determining the indication context (e.g., external conditions around the indication), verifying trigger source authorization, verifying end user privacy terms, or determining any other appropriate indication information. If vehicle data server 302 determines that the indication comprises an indication to enter into a specialized data collection mode, the indication to enter into a specialized data collection mode is sent to vehicle event recorder 304. In some embodiments, the indication to enter into a specialized data collection mode comprises instructions (e.g., specialized data collection mode type, specialized data collection mode duration, etc.). Vehicle event recorder 304 receives the indication to enter the specialized data collection mode and instructs data collection devices 306 to collect data according to the specialized data collection mode. In various embodiments, the specialized data collection mode comprises a single data collection, a repeated data collection, an extended data collection (e.g., data collection continues until a command to stop the specialized data collection mode is received), or any other appropriate data collection mode. Data collection devices 306 collect data (e.g., video data, audio data, sensor data), and store it in vehicle event reorder 304. In some embodiments, vehicle event recorder 304 immediately transmits data from data collection devices 306 to vehicle data server 302.

Figure 4:
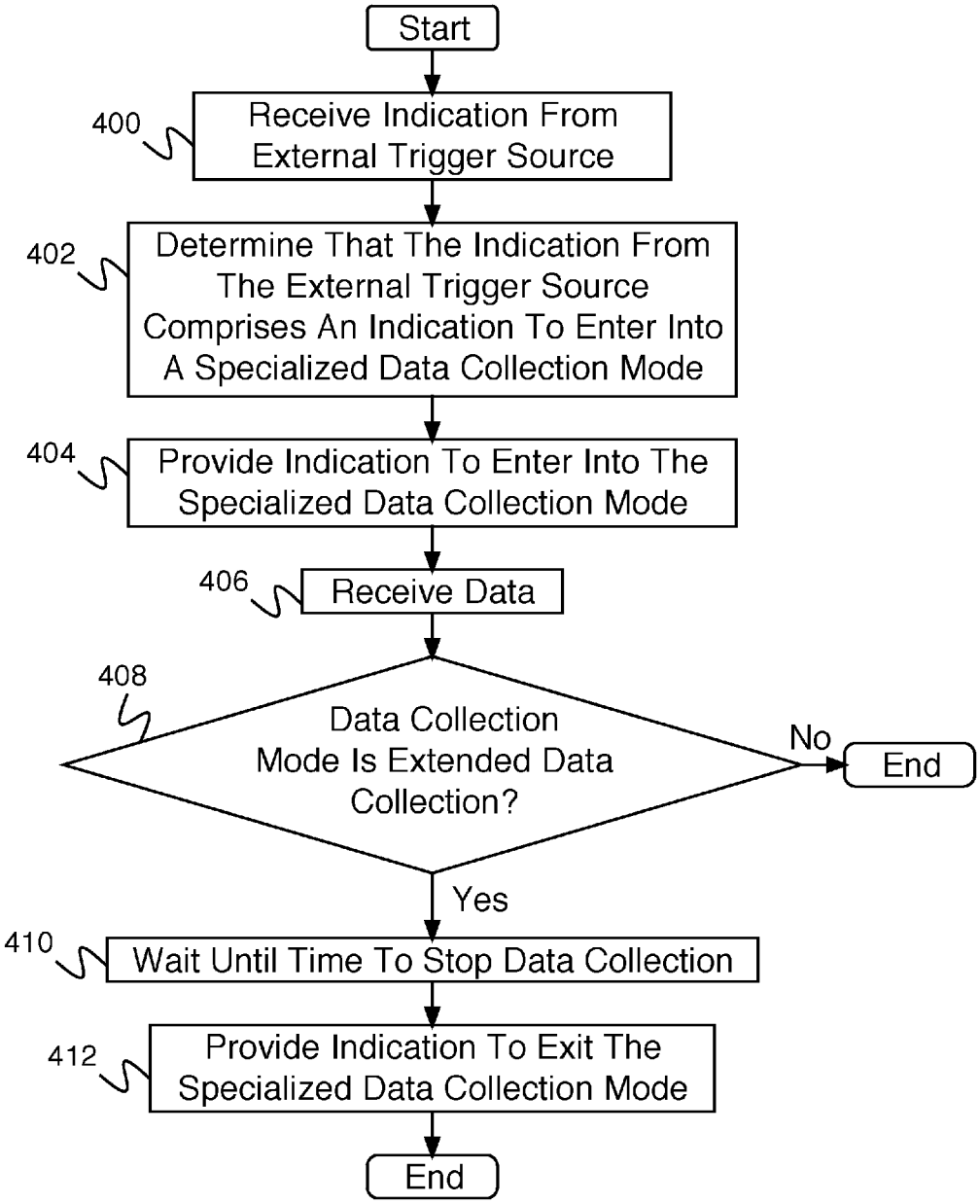
FIG. 4 is a flow diagram illustrating an embodiment of a process for triggering a specialized data collection mode.

FIG. 4 is a flow diagram illustrating an embodiment of a process for triggering a specialized data collection mode. In some embodiments, the process of FIG. 4 is executed by a vehicle data server (e.g., vehicle data server 104 of FIG. 1). In the example shown, in 400, the vehicle data server receives an indication from an external trigger source. In 402, the vehicle data server determines that the indication from the external trigger source comprises an indication to enter into a specialized data collection mode. In 404, an indication is provided (e.g., to a vehicle event recorder) to enter into the specialized data collection mode. In some embodiments, the specialized data collection mode comprises disabling outputs (e.g., in the event that the indication from the external trigger source comprises a stolen vehicle recovery system indication). In some embodiments, the specialized data collection mode comprises alerting a supervisor (e.g., in the event that the indication from the external trigger source comprises a stolen vehicle recovery system indication). In 406, data is received (e.g., the data collected during the specialized data collection mode. In 408, it is determined whether the data collection mode comprises extended data collection (e.g., whether the data collection will continue until an indication to stop the data collection is received). If it is determined that the data collection mode is not extended data collection, the process ends. If it is determined that the data collection mode is extended data collection, control passes to 410. In 410, the process waits until time to stop data collection. In 412, an indication is provided to exit the specialized data collection mode.

Figure 5:
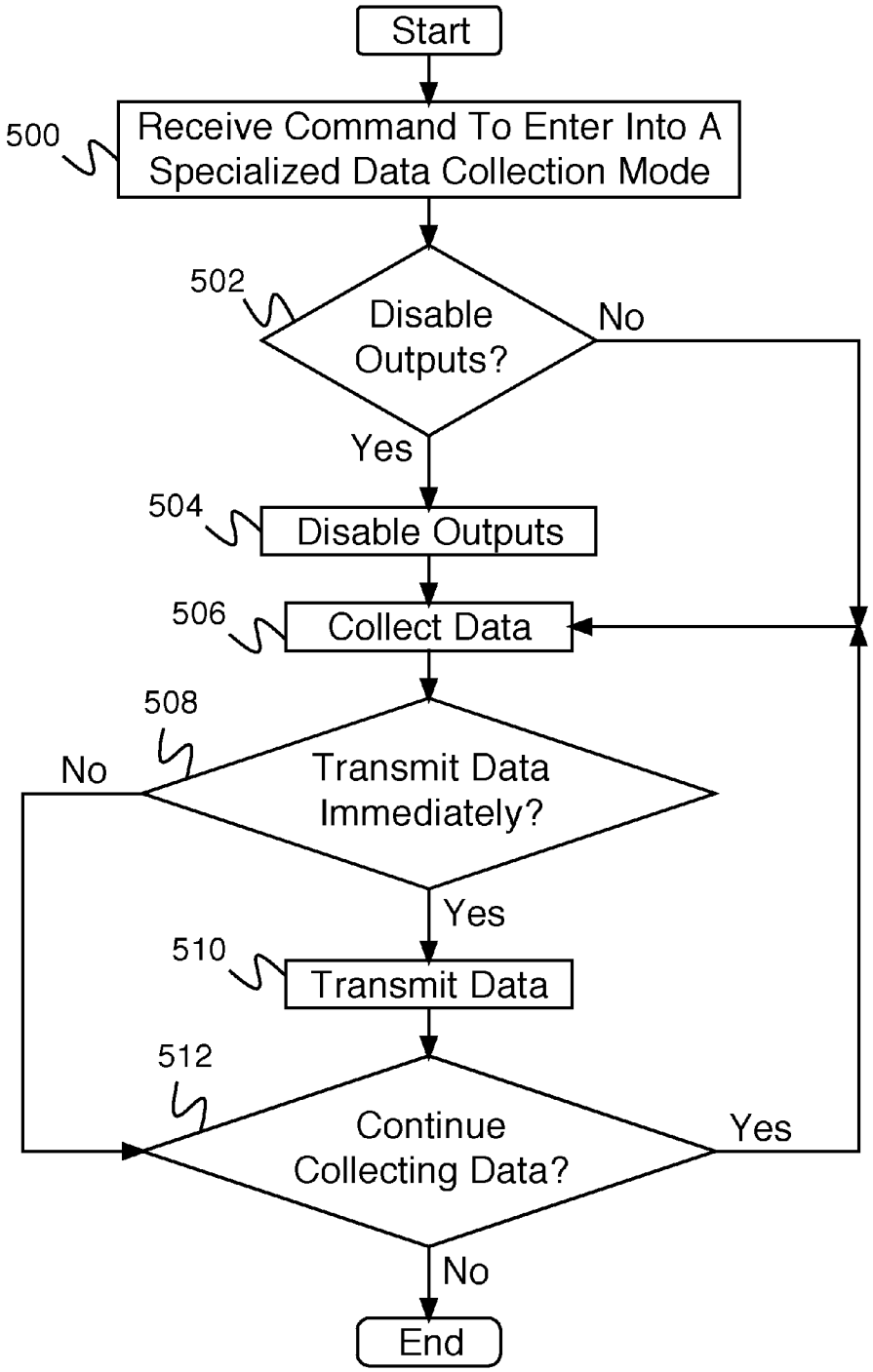
FIG. 5 is a flow diagram illustrating an embodiment of a process for entering a specialized data collection mode.

FIG. 5 is a flow diagram illustrating an embodiment of a process for entering a specialized data collection mode. In some embodiments, the process of FIG. 5 is executed by a vehicle event recorder (e.g., vehicle event recorder 102 of FIG. 1). In the example shown, in 500, a command is received (e.g., from a vehicle data server) to enter into a specialized data collection mode. In 502, the vehicle event recorder determines whether to disable outputs. In some embodiments, determining whether to disable outputs comprises examining the command to enter a specialized data collection mode. In some embodiments, outputs are disabled in the event of a possible vehicle theft. If it is determined not to disable the outputs, control passes to 506. If it is determined to disable the outputs, control passes to 504. In 504, outputs are disabled. In various embodiments, disabling outputs comprises disabling light-emitting diode (LED) outputs, disabling audio outputs, disabling video outputs, disabling data outputs, or disabling any other appropriate outputs. In 506, data is collected. In various embodiments, the data comprises video data, audio data, still image data, sensor data, or any other appropriate data. In some embodiments, the type of data to collect is indicated in the command to enter into a specialized data collection mode. In 508, the vehicle event recorder determines whether to transmit the data immediately. In some embodiments, determining whether to transmit the data immediately comprises examining the command to enter into a specialized data collection mode. If it is determined that the data should be transmitted immediately, control passes to 510. In 510, data is transmitted (e.g., to a vehicle data server). Control then passes to 512. If it is determined in 508 that data should not be transmitted immediately, control passes directly to 512. In 512, the vehicle event recorder determines whether it should continue collecting data. In some embodiments, determining whether to continue collecting data comprises examining the command to enter into a specialized data collection mode. In various embodiments, the vehicle event recorder collects data for a single frame (e.g., a still image of video data, a single measurement of sensor data, etc.), for a predetermined number of frames, for a predetermined period of time, until a command to stop collecting data is received, indefinitely, or for any other appropriate period of time. In some embodiments, determining whether to continue collecting data comprises determining whether a command to stop collecting data has been received. In the event it is determined to continue collecting data, control passes to 506. In the event it is determined not to continue collecting data, the process ends.

In some embodiments, the common system installation consists of an event recorder installed in a vehicle with wireless connectivity supporting GSM, CDMA, Universal Mobile Telecommunications System (UMTS), Long Term Evolution (LTE), Integrated Digital Enhanced Network (iDEN), WiMax, WiFi or some other generally available wireless data access system. Additionally the system has a backend component that consists of access points in support of requesting real-time information from the installed event recorder. The access points can include secure web service access or user interface (graphical or command line). On request from one of the access points (a variety of request use cases are detailed in the following sections), the system supports requesting additional information from the event recorder including but not limited to the following: real-time capture and transmission of a video clip from all available cameras, real-time capture and transmission of a still frame from all available cameras, iterative capture and transmission of video clips (e.g., a 12 second clip every T minutes), iterative capture and transmission of still frame images (e.g., an image every T seconds), real-time capture and transmission of event recorder or vehicle meta data or iterative capture and transmission of event recorder or vehicle meta data.

With a "How's My Driving" type program, vehicles are marked as being part of a "How's My Driving" program with an accompanying 800 number and vehicle identification number (these markings are typically large decals). For this type of service, feedback on driver safety is crowd sourced from other motorists that may or may not be trained in motor vehicle safety assessment. Additionally while most calls are expected to provide valid feedback, there is no proof supporting the call nor is there accountability on the part of the caller. To improve the effectiveness of this type of service and to supply coaching opportunities, this invention allows "How's My Driving" calls to capture video evidence supporting both positive and negative feedback scenarios. The vehicle data server system is interconnected with the participating "How's My Driving" programs. This integration is typically implemented as a secure web service. The integration allows for a trigger to the vehicle data server system to initiate a real-time video capture based on the crowd source feedback. Therefore the call to the "How's My Driving" typically captures the vehicle ID either thru an operator or an Interactive Voice Response (IVR) process. On vehicle ID capture, a request is sent to the vehicle data server system to initiate the capture and transfer of a real-time video. This request contains the required information to identify the specific vehicle event recorder within the system (e.g., vehicle ID, vehicle company identifier and "How's My Driving" provider). Additionally, the system may support a subsequent web service call on completion of the caller to "How's My Driving" session to delivery any additional details such as the reason the call was made. On receipt of the initial request, the vehicle data server system identifies the driver's event recorder and initiates the request for real-time capture and transfer of content. The request for real-time capture and transfer of content can be supported using any appropriate channel and wireless method including but not limited to a Short Message Service (SMS) message with the content request embedded, an SMS message with a preconfigured content type, a Wide Area Protocol (WAP) push, a phone call to the device, a phone call to the device with an IVR session, a phone call to the device with a voice recognition session, a web service call to the event recorder or any other method. Based on receipt of this message and action determination, the vehicle event recorder fulfills the real-time data request and subsequently performs a check-in to support delivery of the requested content. The delivery of data in part or in whole is determined based on a summary of available content, the backend system determines if additional content should be transferred at that time or later. The request is to be logged regarding request time & fulfillment time in support of data correlation to the original request. For the case of "How's My Driving", this will be based on the customer configuration. During the data, video and/or still image capture, the vehicle event recorder signals to the driver that data is being captured—the driver feedback from the event recorder is based on system configuration. The driver feedback may consist of a LED pattern, audio feedback or haptic feedback. These events will be identified as captured by "How's My Driving" to support supervisor review. Additionally, the events will be processed thru the supported human review and/or automated review to identify any safety risk or positive driving behaviors.

An Electronic On-Board Recorder (EOBR) violation is similar to the previous "How's My Driving" use case. For the case of a 3rd party EOBR solution with backend integration, the event recorder does not have access to the EOBR data. In this case, the EOBR data is transmitted from the EOBR to the supported 3rd party backend data collection point. The vehicle data server receives the data from backend integration between the 3rd party and the vehicle event recorder system. For the case of a real-time hours of service (HOS) violation, the indication from the 3rd party can be used as an initiation of a real-time content request from the event recorder. For this case a still image is sufficient to identify the passenger. This is an important feature for coaching opportunities. For the case of team drivers the issue may be a true HOS violation or the driver forgetting to update the EOBR.

The stolen car use case is also similar to the previous "How's My Driving" use case. In this scenario, the triggering event could be from a driver calling in the issue & the real-time content request is issued by a system administrator with appropriate security privileges, or from integration with a stolen vehicle recovery system like LoJack (this would leverage a web service integration). The stolen recovery use case would support the following additional system differences: disabling of the event recorder LED(s), disabling of the event recorder speakers, iteratively capturing and transferring video clips until the event recorder is no longer in a stolen vehicle state, alerting the supervisor/management team would be at initiation as opposed to initial event transfer, and sending an additional alert for the initial event transfer.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system for triggering a specialized data collection mode of a vehicle event recorder, comprising:

an input interface configured to receive a trigger indication from an external trigger source;

a processor configured to:

determine whether the trigger indication comprises an indication to enter into a specialized data collection mode, wherein in the specialized data collection mode vehicle state data including at least some data not associated with an anomalous event is transmitted to a remote server;

in the event that the trigger indication comprises the indication to enter into the specialized data collection mode, determine a vehicle event recorder associated with the trigger indication; and an output interface configured to provide a specialized data collection mode indication to enter the specialized data collection mode to the vehicle event recorder in the event that the trigger indication comprises the indication to enter into the specialized data collection mode.

2. The system of claim 1, wherein the indication from the external trigger source comprises an indication of an incorrect driver ID.

3. The system of claim 1, wherein the indication from the external trigger source comprises an indication of a dangerous driver behavior.

4. The system of claim 1, wherein the indication from the external trigger source comprises an indication of a route deviation.

5. The system of claim 1, wherein the indication from the external trigger source comprises an indication of an incorrect geozone.

6. The system of claim 1, wherein the indication from the external trigger source comprises a manual indication.

7. The system of claim 1, wherein the indication from the external trigger source comprises a stolen vehicle recovery system indication.

8. The system of claim 1, wherein the indication from the external trigger source comprises a call-in driver alert system indication.

9. The system of claim 1, wherein the indication from the external trigger source comprises an electronic on-board recorder system indication.

10. The system of claim 1, wherein the output interface is further configured to provide an exit indication to exit the specialized data collection mode to the vehicle event recorder.

11. The system of claim 1, wherein the specialized data collection mode comprises a single data collection.

12. The system of claim 1, wherein the specialized data collection mode comprises a repeated data collection.

13. The system of claim 1, wherein the specialized data collection mode comprises collection of still image data.

14. The system of claim 1, wherein the specialized data collection mode comprises collection of video data.

15. The system of claim 1, wherein the specialized data collection mode comprises collection of audio data.

16. The system of claim 1, wherein the specialized data collection mode comprises collection of sensor data.

17. The system of claim 1, wherein the specialized data collection mode comprises disabling outputs.

18. The system of claim 1, wherein the specialized data collection mode comprises alerting a supervisor.

19. A computer program product for triggering a specialized data collection mode of a vehicle event recorder, the computer program product being embodied in a non-transitory computer readable storage medium and comprising computer instructions for:

receiving a trigger indication from an external trigger source;

determining, using a processor, whether the trigger indication comprises an indication to enter into a specialized data collection mode, wherein in the specialized data collection mode vehicle state data including at least some data not associated with an anomalous event is transmitted to a remote server; and in the event that the trigger indication comprises the indication to enter into the specialized data collection mode, determining a vehicle event recorder associated with the trigger indication; and providing a specialized data collection mode indication to enter the specialized data collection mode to the vehicle event recorder.

20. The system of claim 1, wherein the at least some data not associated with an anomalous event is immediately transmitted to a remote server.

21. A method for triggering a specialized data collection mode of a vehicle event recorder, comprising:

receiving a trigger indication from an external trigger source;

determining, using a processor, whether the trigger indication comprises an indication to enter into a specialized data collection mode, wherein in the specialized data collection mode vehicle state data including at least some data not associated with an anomalous event is transmitted to a remote server; and in the event that the trigger indication comprises the indication to enter into the specialized data collection mode, determining a vehicle event recorder associated with the trigger indication; and providing a specialized data collection mode indication to enter the specialized data collection mode to the vehicle event recorder.

* * * * *